US008955938B2

(12) United States Patent
Kobayashi

(10) Patent No.: US 8,955,938 B2
(45) Date of Patent: Feb. 17, 2015

(54) INKJET RECORDING DEVICE

(71) Applicant: Isao Kobayashi, Nagoya (JP)

(72) Inventor: Isao Kobayashi, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 26 days.

(21) Appl. No.: 13/848,165

(22) Filed: Mar. 21, 2013

(65) Prior Publication Data

US 2013/0257952 A1 Oct. 3, 2013

(30) Foreign Application Priority Data

Mar. 30, 2012 (JP) ..... 2012-079429

(51) Int. Cl.
*B41J 29/38* (2006.01)
*B41J 2/045* (2006.01)
*B41J 2/21* (2006.01)

(52) U.S. Cl.
CPC ..... *B41J 2/04501* (2013.01); *B41J 2/2128* (2013.01); *B41J 2/2132* (2013.01)
USPC ..... 347/14

(58) Field of Classification Search
CPC ..... B41J 2/04501; B41J 2/04536; B41J 2/04593; B41J 2/04551; B41J 2/2132
USPC ..... 347/14
See application file for complete search history.

(56) References Cited

U.S. PATENT DOCUMENTS

| | | | | |
|---|---|---|---|---|
| 7,784,894 | B2 * | 8/2010 | Maehira et al. | 347/16 |
| 2003/0035021 | A1 | 2/2003 | Masuyama et al. | |
| 2005/0041050 | A1 | 2/2005 | Masuyama et al. | |
| 2008/0158275 | A1 * | 7/2008 | Masuyama et al. | 347/9 |
| 2009/0051944 | A1 * | 2/2009 | Bracke et al. | 358/1.9 |
| 2009/0284559 | A1 * | 11/2009 | Sudo et al. | 347/14 |

FOREIGN PATENT DOCUMENTS

| | | | |
|---|---|---|---|
| JP | 2003-127341 | A | 5/2003 |
| JP | 2004-237574 | A | 8/2004 |
| JP | 2011-235989 | A | 11/2011 |

* cited by examiner

*Primary Examiner* — Alessandro Amari
*Assistant Examiner* — Michael Konczal
(74) *Attorney, Agent, or Firm* — Scully, Scott, Murphy & Presser, P.C.

(57) ABSTRACT

An inkjet recording device includes: first and second pairs of rollers for conveying a sheet while nipping the sheet; and a recording head disposed between the first and seconds pairs of rollers. The recording head performs an image recording on the sheet by ejecting ink droplets onto the sheet when the sheet is stopped in an intermittent conveyance of the sheet. The recording head performs the image recording in accordance with a first image-recording data, before a trailing end of the sheet passes through the first pair of rollers that is disposed on an upstream side of the second pair of rollers. The recording head performs the image recording in accordance with a second image-recording data which is based on the first image-recording data and which has a higher image resolution than the first image-recording data, after the trailing end of the sheet passes through the first pair of rollers.

13 Claims, 9 Drawing Sheets

INKJET RECORDING DEVICE

CROSS-REFERENCE TO RELATED APPLICATION

This application claims priority from Japanese Patent Application No. 2012-079429 filed on Mar. 30, 2012, the disclosure of which is herein incorporated by reference in its entirety.

BACKGROUND OF THE INVENTION

1. Field of the Invention

The present invention relates to an inkjet recording device for recording an image on a sheet by ejecting ink droplets through nozzles.

2. Discussion of Related Art

Conventionally, there has been known an inkjet recording device for performing an image recording, by conveying a sheet in a conveyance direction along a conveyance path and by ejecting ink droplets toward the conveyed sheet.

In the known inkjet recording device, a plurality of pairs of rollers are disposed along the conveyance path, so that the sheet is conveyed by being nipped by the pairs of rollers. It is common that a pair of rollers is disposed on an upstream side of a recording unit in the conveyance direction while another pair of rollers is disposed on a downstream side of the recording unit in the conveyance direction, so that an image recording is performed on the sheet in a state in which the sheet is nipped, at its leading end portion and trailing end portion in the conveyance direction, by the two pairs of rollers, namely, in a state in which a position of the sheet is stabilized.

SUMMARY OF THE INVENTION

However, in the above-described inkjet recording device, when the image recording is performed to the trailing end portion of the sheet, the trailing end portion of the sheet is no longer nipped by one of the two pairs of rollers which is disposed on the upstream side of the recording unit, so that a position of the trailing end portion of the sheet becomes unstable. There is a risk that the image recording performed in such an unstable state would lead to a reduction in quality of the image recorded by the recording unit.

The present invention was made in view of the above-described background problem. It is therefore an object of the invention to provide an inkjet recording device that makes it possible to restrain a problematic reduction in quality of an image that is recorded on a sheet even after a trailing end portion of the sheet has passed through a pair of rollers which is provided for nipping the sheet.

The above object of the invention may be achieved according to a principle of the invention, which provides an inkjet recording device including: (a) a first pair of rollers configured to convey a sheet in a conveyance direction that is along a conveyance path while nipping the sheet; (b) a second pair of rollers disposed on an downstream side of the first pair of rollers in the conveyance direction, and configured to convey the sheet in the conveyance direction while nipping the sheet; (c) a recording head disposed between the first pair of rollers and the second pair of rollers in the conveyance direction, the recording head being configured to eject ink droplets toward the conveyance path through nozzles that are arranged in the conveyance direction; and (d) a controller configured to cause the first and second pairs of rollers to perform an intermittent conveyance for alternately conveying and stopping the sheet, and to cause the recording head to perform an image recording on the sheet by ejecting the ink droplets onto the sheet when the sheet is being stopped in the intermittent conveyance, wherein the controller is configured to cause the recording head to perform the image recording in accordance with a first image-recording data, before a trailing end of the sheet passes through the first pair of rollers, and wherein the controller is configured to cause the recording head to perform the image recording in accordance with a second image-recording data which is based on the first image-recording data and which has a higher image resolution than the first image-recording data, after the trailing end of the sheet passes through the first pair of rollers. It is noted that the above-described term "image recording" may be referred also to as "a series of image recordings". It is also noted that the above-described phrase "perform an image recording on the sheet" may be interpreted to mean that "record an image on the sheet". It is further noted that the above-described phrases "perform the image recording in accordance with a first image-recording data" and "perform the image recording in accordance with a second image-recording data" may be interpreted to also mean that "record an image relating to a first image-recording data" and "record an image relating to a second image-recording data", respectively.

DETAILED DESCRIPTION OF THE PREFERRED EMBODIMENT

Figure 1:
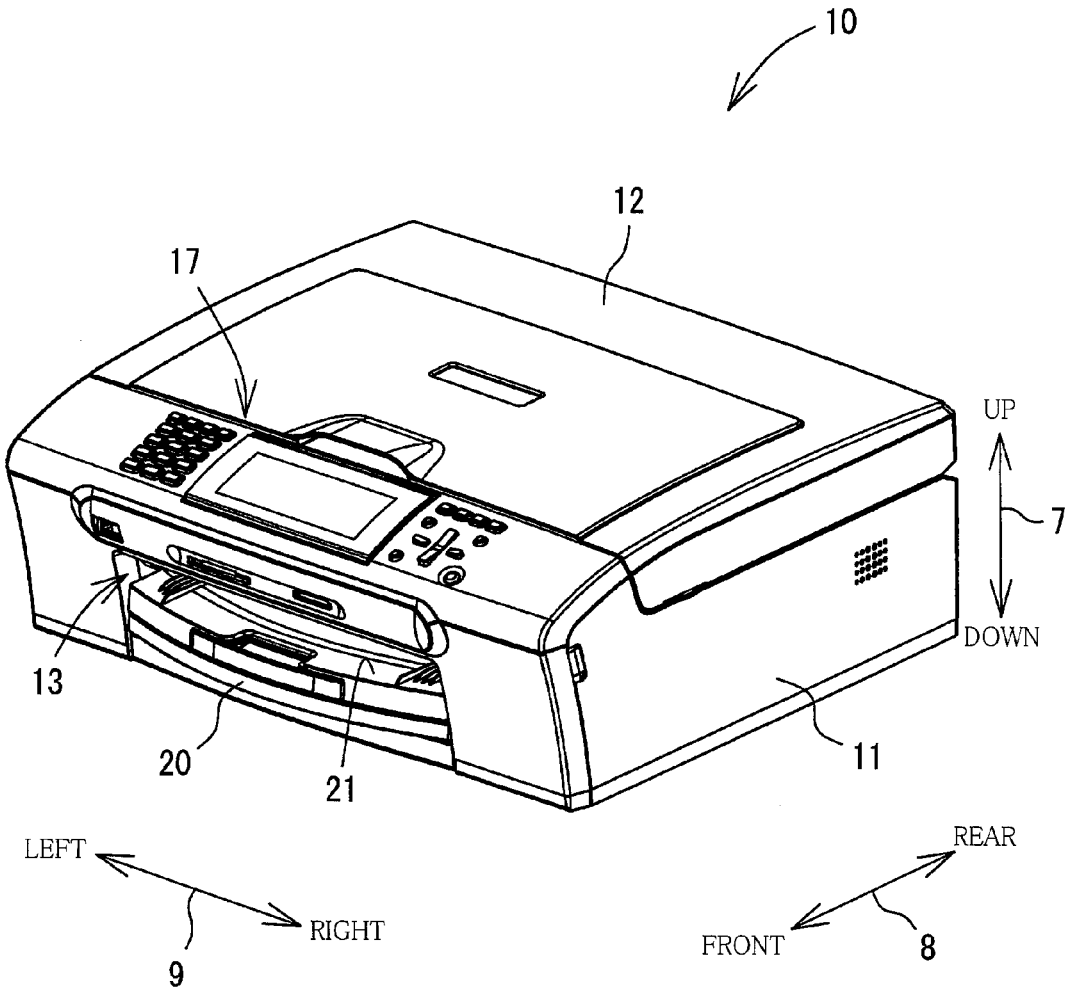
FIG. 1 is a perspective view of a compound machine 10 including a printer unit 11 that is constructed according an embodiment of the invention.

There will be described an embodiment of the present invention, by reference to the accompanying drawings. It is noted that the embodiment will be described for illustrative purpose only and that the invention may be embodied with various changes, modifications and improvements, which may occur to those skilled in the art, without departing from the spirit of the invention. It is also noted that, in the following direction, a term "conveyance direction" refers to a sense or direction in which a sheet is to be conveyed, i.e., a sense or direction indicated by broken-line arrow in FIG. 2, and that each of the other directions such as an up-down direction 7, a front-rear direction 8 and a right-left direction 9 refers to both of opposite directions that are parallel to a corresponding arrow in FIG. 1, 2 or 8. It is further noted that, in the following description, there will be used terms "upper", "lower", "right", "left", "front" and "rear" directions of a compound machine 10 which are directions as seen in FIG. 1, and which are indicated by respective arrows "UP", "DOWN", "RIGHT", "LEFT", "FRONT" and "REAR" in the drawings. The up-down direction 7 is defined as seen in FIG. 1 in which the compound machine 1 is set to be usable. The front-rear direction 8 is defined with an assumption that a portion of the machine 10, in which an opening 13 is provided, is a front portion of the machine 10. Further, the right-left direction 9 is defined as seen from a side of the front portion of the machine 10.

As shown in FIG. 1, the compound machine 10 has a generally rectangular parallelepiped body with a low profile. A scanner unit 12 is provided in an upper portion of the machine 10. The scanner unit 12 is configured to obtain a printing data (i.e., image recording data) by causing an image sensor to read an image that is recorded on an original copy such as a recording sheet. Further, a printer unit 11 (an example of the inkjet recording device according to the invention) is provided in a lower portion of the machine 10. The printer unit 11 is configured to record an image on a recording sheet 15 (as an example of a sheet) (see FIG. 2), based on the printing data obtained by the scanner unit 12 or a printing data (i.e., image recording data) transmitted from an external device such as a personal computer that is connected to the compound machine 10 via LAN.

In the present embodiment, the above-described printing data contains an image data representing or relating to an image that is to be formed or recorded on the recording sheet 15 by a printing operation (i.e., image recording operation) and also commands required for controlling formation of the image (that is represented by the image data) on the recording sheet 15. As the commands, there is a print command commanding start the printing operation, for example. In the following described, however, the term "printing data" refers simply to the image data representing or relating to an image that is to be formed or recorded on the recording sheet 15 by the printing operation, unless otherwise specified.

A sheet supply tray 20, in which the recording sheets 15 are to be stacked, is fitted in the opening 13 that opens in a front surface of the printer unit 11. The sheet supply tray 20 can be introduced into and removed from an inner space of the compound machine 10 via the opening 13, by moving the tray 20 in the front-rear direction 8. The sheet supply tray 20 is covered at its front upper portion by a sheet exit tray 21, which is slidable integrally with the sheet supply tray 20.

Figure 2:
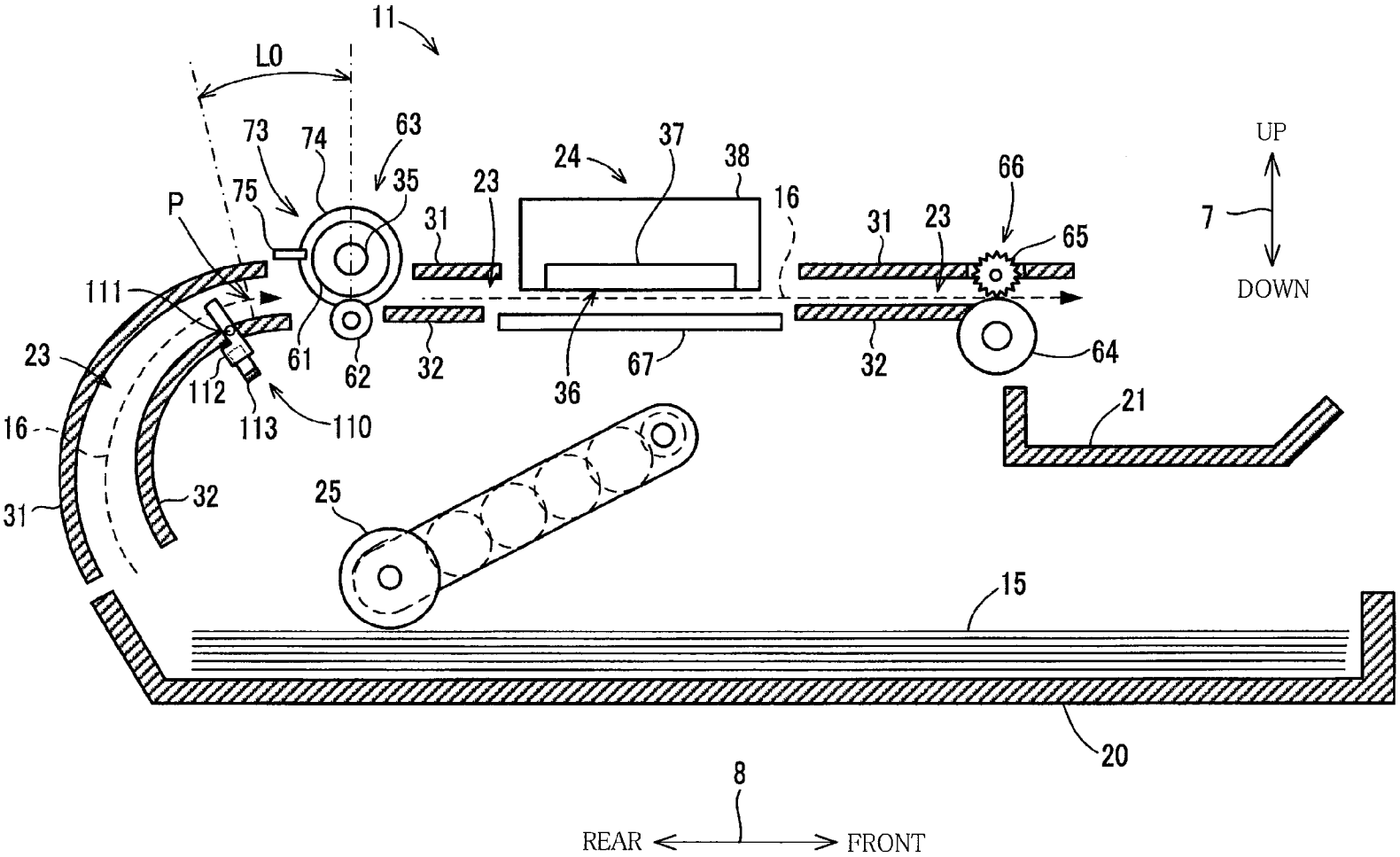
FIG. 2 is a vertical cross-sectional view schematically showing an internal construction of the printer unit 11.

As shown in FIG. 2, the printer unit 11 has: a conveyance path 23 along which the recording sheets 15 are to be conveyed; a sheet supplying roller 25 that is to be rotated by a sheet supply motor 102 (see FIG. 9) so as to supply the recording sheets 15 stacked in the sheet supply tray 20, to the conveyance path 23; a pair of conveying rollers 63 (as an example of first pair of rollers); a pair of discharging rollers 66 (as an example of second pair of roller); and an inkjet-type recording unit 24 for recording an image represented by the printing data, on each recording sheet 15. The pair of conveying rollers 63 and the pair of pair of discharging rollers 66 are provided in the conveyance path 23 so as to convey the recording sheets 15 that are supplied to the conveyance path 23. It is noted that the sheet supplying roller 25 may be rotated by a sheet convey motor 101 (described below) in place of the sheet supply motor 102.

[Conveyance Path 23]

As shown in FIG. 2, the conveyance path 23 includes a curved path section and a straight path section that is contiguous to the curved path section, so as to have a generally U shape as a whole, so that each recording sheet 15 conveyed along the conveyance path 23 is caused to make a U turn. The curved path section extends generally upwardly from a rear end portion of the sheet supply tray 20. The straight path section extends forwardly from the curved path section to the sheet exit tray 21, passing below the recording unit 24. The conveyance path 23 is constituted by a space defined between a first guide member 31 and a second guide member 32 that are opposed to each other with a given spacing distance therebetween. Each recording sheet 15 is conveyed along the conveyance path 23 in a conveyance direction 16 that is a direction indicated by broken-line arrow in FIG. 2, such that a leading end of the conveyed recording sheet 15 is positioned on a front side of a trailing end of the conveyed recording sheet 15 in the conveyance direction 16. It is noted that the leading end and the trailing end of the recording sheet 15 may be referred also to as a downstream end and an upstream end of the recording sheet 15, respectively, as viewed in the conveyance direction 16.

[Pair of Conveying Rollers 63 & Pair of Discharging Rollers 66]

As shown in FIG. 2, the pair of conveying rollers 63 is disposed in the conveyance path 23 and is located on an upstream side of the recording unit 24 in the conveyance direction 16. The pair of conveying rollers 63 consists of a conveying roller 61 and a pinch roller 62 that is pressed against a roller surface of the conveying roller 61 by a biasing force of an elastic member (not shown) such as a spring. The pair of discharging rollers 66 is disposed in the conveyance path 23 and is located on a downstream side of the recording unit 24 in the conveyance direction 16. The pair of discharging rollers 66 consists of a discharging roller 64 and a spur roller 65 that is pressed against a roller surface of the discharging roller 64 by a biasing force of an elastic member (not shown) such as a spring.

Figure 9:
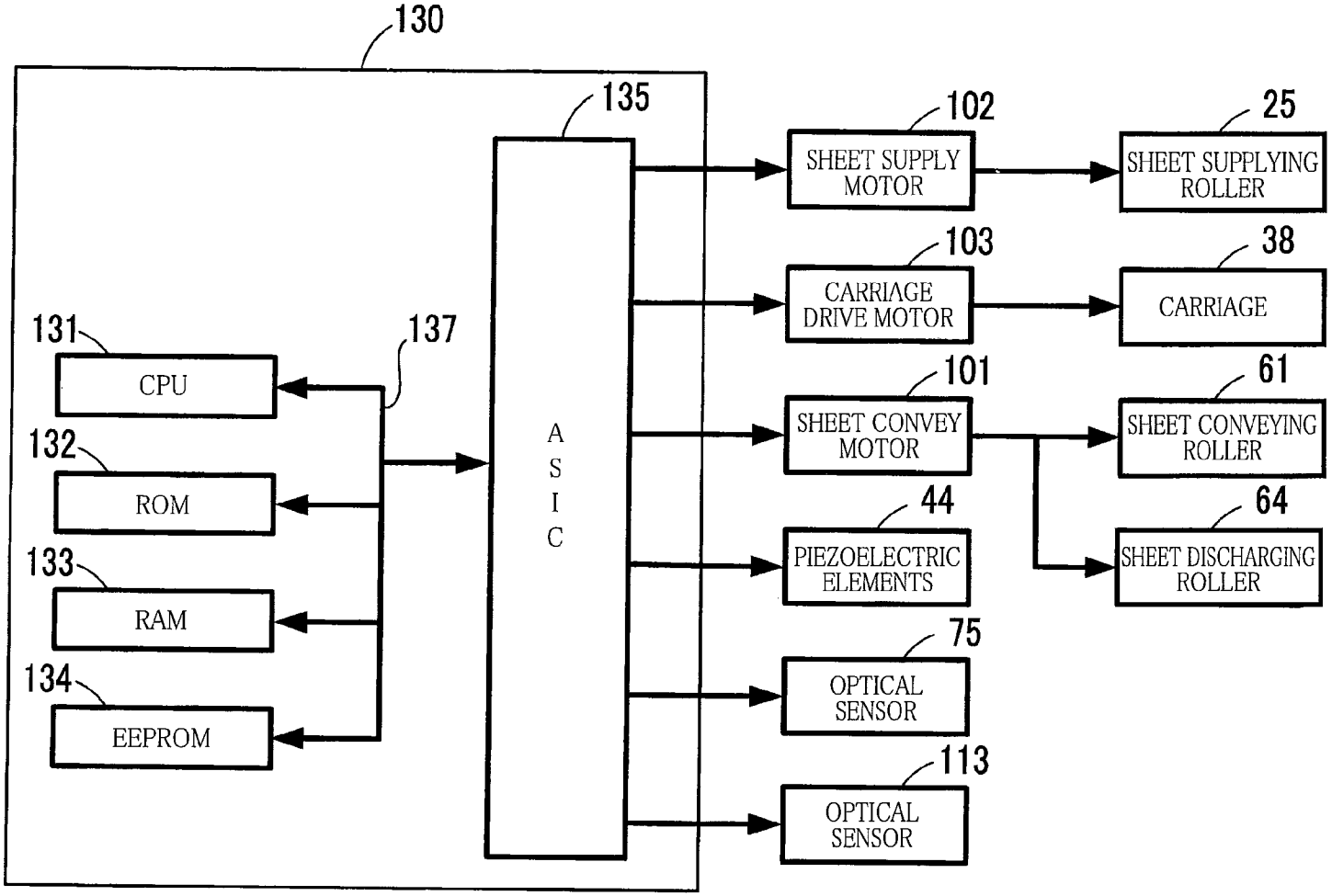
FIG. 9 is a block diagram showing a construction of a controller 130 included in the compound machine 10.

Each of the conveying roller 61 and discharging roller 64 is rotated by a driving force that is transmitted from the sheet convey motor 101 (see FIG. 9). Each of the conveying roller 61 and discharging roller 64, to which the driving force is transmitted, cooperates with a corresponding one of the pinch roller 62 and spur roller 65, to nip the recording sheet 15 therebetween, so that the nipped sheet is conveyed by the conveying roller 61 and discharging roller 64, in the conveyance direction 16.

[Recording Unit 24]

As shown in FIG. 2, the recording unit 24 is disposed in the conveyance path 23 and is located between the pair of conveying rollers 63 and the pair of discharging rollers 66 in the conveyance direction 16. The recording unit 24 includes an inkjet recording head 37 and a carriage 38 that carries the recording head 37. The carriage 38 is supported by a frame (not shown) of the printer unit 11, such that the carriage 38 is reciprocally movable in the right-left direction 9. The carriage 38 is connected to a carriage drive motor 103 (see FIG. 9) via a known belt mechanism, so as to be reciprocally moved in the right-left direction 9 by a driving force that is transmitted thereto from the carriage drive motor 103.

The recording head 37 has: a plurality of nozzles 36 that are provided in its lower surface; ink passages (not shown) that communicates sub-tanks (not shown) and the nozzles 36; and piezoelectric elements 44 (see FIG. 9) each of which is to be activated to deform a part of a corresponding one of the ink passages, so as to eject ink droplets through a corresponding one of the nozzles 36, toward a platen 67 provided in a position which is located below the recording head 37 and is opposed to the recording head 37. The platen 67 is a member that serves to support the recording sheet 15. Each piezoelectric element 44 is activated by an electric supply under control by a controller 130 (see FIG. 9).

Each of the sub-tanks stores therein a corresponding one of cyan, magenta, yellow and black color inks. The plurality of nozzles 36 are arranged in a plurality of nozzle rows. In the present embodiment, the sub-tank storing the cyan color ink is held in communication with the nozzles 36 that are arranged in a first nozzle row (not shown). Similarly, the sub-tanks storing the magenta, yellow and black color inks are held in communication with the nozzles 36 arranged in a second nozzle row (not shown), the nozzles 36 arranged in a third nozzle row (not shown) and the nozzles 36 arranged in a fourth nozzle row (not shown), respectively. Each of the first, second, third and fourth rows extends in the front-rear direction 8 (i.e., conveyance direction 16). The first, second, third and fourth rows are arranged in the right-left direction 9.

The recording unit 24 is controlled by the controller 130 (see FIG. 9), such that the carriage 38 is reciprocally movable in the right-left direction 9 and the recording head 37 ejects the ink droplets through the plurality of nozzles 36 toward the conveyance path 23, whereby an image is recorded on the recording sheet 15 supported on the platen 67. It is noted that the recording unit 24 is not required to include the carriage 38 where the nozzles 36 are provided over an entire range of a recording area in the right-left direction 9.

[Detector 110]

As shown in FIG. 2, a detector 110 is disposed in the conveyance path 23 and is located on an upstream side of the pair of conveying rollers 63 in the conveyance direction 16. The detector 110 includes: a shaft 111; a detecting element 112 pivotable about the shaft 111; and an optical sensor 113 having a light emitting element and a light receiving element that is configured to receive a light emitted from the light emitting element.

The detecting element 112 includes a protruding end portion that protrudes into the conveyance path 23. In a state in which an external force is not being applied to the protruding end portion of the detecting element 112, another end portion of the detecting element 112 is introduced into a light path that extends from the light emitting element to the light receiving element, so as to interrupt a light passing along the light path. In this state, the optical sensor 113 outputs a low-level signal that is supplied to the controller 130 (see FIG. 9). When the protruding end portion of the detecting element 112 is forced by the leading end of the recording sheet 15, the detecting element 112 is rotated whereby the above-described another end portion of the detecting element 112 is displaced away from the light path so that the light is allowed to pass along the light path. In this instance, the optical sensor 113 outputs a high-level signal that is supplied to the controller 130. Thus, the controller 130 is configured to the leading and trailing ends of the recording sheet 15, based on the signal supplied from the optical sensor 113.

[Rotary Encoder 73]

As shown in FIG. 2, a rotary encoder 73 is provided for the conveying roller 61, so as to detect an amount of rotation of the conveying roller 61. The rotary encoder 73 is constituted principally by an optical sensor 75 and an encoder disk 74 that is attached to a shaft 35 of the conveying roller 61 to be rotatable together with the conveying roller 61. The encoder disk 74 has light transmitting portions (through which a light is transmittable) and light non-transmitting portions (through which a light is not transmittable) which are alternately arranged in a circumferential direction of the disk 74 and are equi-angularly spaced apart from each other in the circumferential direction. During rotation of the encoder disk 74 together with the shaft 35 of the conveying roller 61, a pulse signal is generated when each one of the light transmitting portions or each one of the light non-transmitting portions is detected by the optical sensor 75. The generated pulse signal is supplied to the controller 130 (see FIG. 9). The controller 130 is configured to detect the amount of rotation of the conveying roller 61, based on the pulse signal supplied from the rotary encoder 73.

[Controller 130]

There will be described an outline configuration of the controller 130 with reference to FIG. 9. The invention is practiced by execution of a recording control routine (represented by flow charts described below) by the controller 130 that is configured to control operations of the entirety of the compound machine 10. The controller 130 includes CPU 131, ROM 132, RAM 133, EEPROM 134, ASIC 135 and an internal bus 137. The CPU 131, ROM 132, RAM 133, EEPROM 134 and ASIC 135 are connected to one another via the internal bus 137.

The ROM 132 is provided for storing therein various programs that are to be executed by the CPU 131 to control operations such as an image recording operation performed in the compound machine 10. The RAM 133 is provided for serving as a storage area for temporarily storing data, signals and the like used for executions of the programs. The EEPROM 134 is provided for storing therein setting information, flag and the like which are to be maintained even after power OFF of the compound machine 10.

To the ASIC 135, there are connected the above-described sheet convey motor 101, sheet supply motor 102 and carriage drive motor 103. The ASIC 135 has drive circuits for controlling the motors 101, 102, 103. When each of the drive circuits of the ASIC 135 receives, from the CPU 131, a drive signal for rotating a corresponding one of the motors 101, 103, 102, a drive current based on the drive signal is supplied from each of the drive circuits to the corresponding motor whereby the corresponding motor is rotated. That is, the controller 130 is configured to control the motors 101, 102, 103.

The ASIC 135 receives the pulse signal outputted by the optical sensor 75. The controller 130 calculates an amount of rotation of the conveying roller 61, based on the pulse signal supplied from the optical sensor 75. Then, the controller 130 calculates an amount of conveyance motion of the recording sheet 15, based on the calculated amount of rotation of the conveying roller 61. Further, the controller 130 detects positions of the leading and trailing ends of the recording sheet 15 relative to a position of disposition of the detector 110, based on the signal supplied from the optical sensor 113 that is also connected to the ASIC 135.

Each of the piezoelectric elements 44, which are also connected to the ASIC 135, is activated by supply of an electric current thereto via a drive circuit (not shown) under control by the controller 130. The controller 130 controls supply of the electric current to the piezoelectric elements 44 such that the ink droplets are ejected through at least selected ones of the nozzles 36 arranged in the plurality of rows. That is, the controller 310 causes the recording head 37 to eject the ink droplets through all or a part of the plurality of nozzles 36.

Further, the controller 130 controls, based on the printing data, the electric current supplied to each piezoelectric element 44, for thereby adjusting the size of the ink droplets ejected through the corresponding nozzle 36.

When an image is to be recorded on the recording sheet 15, the controller 130 controls the sheet convey motor 101 for causing the pair of conveying rollers 63 and the pair of discharging rollers 66 to perform an intermittent conveyance for alternately conveying and stopping the recording sheet 15. The controller 130 causes the recording head 37 to perform an image recording (hereinafter referred to as "one-pass image recording" where appropriate) on the recording sheet 15 when the recording sheet 15 is being stopped between each successive two of intermittent conveyance motions of the intermittent conveyance, such that the ink droplets are ejected through the nozzles 36 by controlling supply of the electric current to each of the piezoelectric elements 44, while the carriage 38 is being moved in a main scanning direction (i.e., right-left direction 9). Described in detail, the controller 130 causes the recording head 37 to eject the ink droplets through the nozzles 36 onto the recording sheet 15, in each one pass of the carriage 38, i.e., in each movement of the carriage 38 from an end of a print range to another end of the print range in the main scanning direction (i.e., right-left direction 9) while the recording sheet 15 is being stopped between each successive two of the intermittent conveyance motions of the intermittent conveyance. In this instance, the controller 130 determines, based on the printing data, which ones of the nozzles 36 the ink droplets are to be ejected though and which sizes of the ink droplets are to be ejected through the ones of the nozzles 36, so that the determined sizes of the ink droplets are ejected through the determined ones of the nozzles 36. Thus, an image represented by the printing data is recorded on the recording sheet 15. The controller 130 controls the sheet convey motor 101 and the recording head 37 such the conveyance motion of the recording sheet 15 and the ejection of the ink droplets through the nozzles 36 are caused alternately. Thus, a printing operation (i.e., image recording operation) for recording the entire image on the recording sheet 15 is completed by a series of the one-pass image recordings, each of which is performed when the recording sheet 15 is being stopped between corresponding successive two of intermittent conveyance motions of the intermittent conveyance. It is noted that the above-described image recording may be referred also to as a series of image recordings. It is noted that what is to be recorded on the recording sheet 15 by each one-pass image recording may be referred to as an image segment that is a part of the entire image.

[Image Recording Control]

In the printer unit 11 constructed as described above, the controller 130 carries out a routine for controlling an image recording operation in which an image represented by a printing data is recorded on the supplied recording sheet 15. With reference to flow chart of FIG. 3, there will be described the routine for controlling the image recording operation.

When a command requesting an image recording operation to be performed on the recording sheet 15 is inputted to the controller 130 from an operator input portion 17 (see FIG. 1) of the compound machine 10 or from an external device connected to the compound machine 10, the controller 130 causes the sheet supplying roller 25 to supply an uppermost one of the recording sheets 15 stacked in the sheet supply tray 20, to the conveyance path 23. Then, the controller 130 causes the pair of conveying rollers 63 to convey the recording sheet 15 in the conveyance direction 16 such that the recording sheet 15 reaches an image recording start position in which the leading end of the recording sheet 15 becomes opposed to the recording unit 24. The image recording start position is interpreted to precisely mean a position in which a front end (as viewed in the conveyance direction 16) of an image recording area on the recording sheet 15 is aligned with or opposed to ones of the nozzles 36 which are located on an upstream side of the other nozzles 36 in the conveyance direction 16.

The controller 130 judges whether or not the printing data (that is inputted from the external device or the operator input portion 17) contains at least one printing data unit (i.e., recording data unit), in accordance with which an image recording has not yet been performed on the recording sheet 15 (at step S10). It is common that the printing data contains such a printing data unit (in accordance with which an image recording has not yet been performed) immediately after the printing data is inputted to the controller 130. Thereafter, steps S20 through S90 are repeatedly implemented as described below, until the controller 130 judges that the image recording operation based on the entire printing data has been completed for the recording sheet 12 ("NO" at step S10).

Figure 7A:
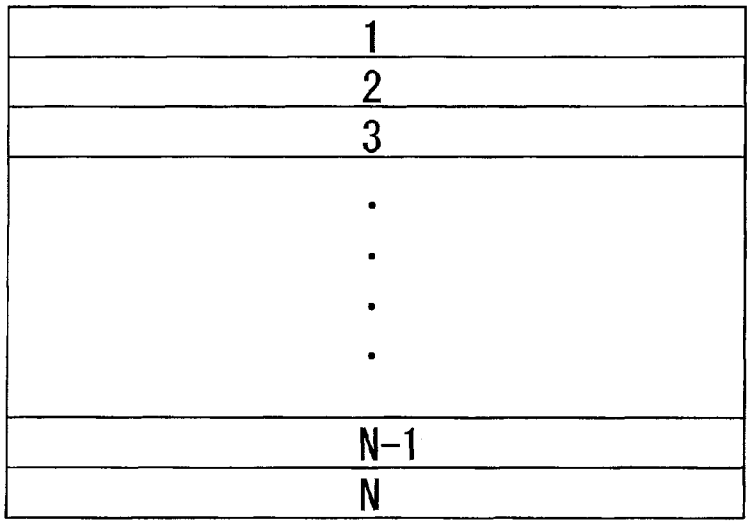
FIG. 7A is a view schematically showing image recordings that are performed on a recording sheet 15, in accordance with a first printing data.

The controller 130 causes the RAM 133 to store therein the printing data inputted from the external device or the operator input portion 17 (at step S20). The printing data stored in the RAM 133 is an example of first image-recording data, and will be referred to as a first printing data in the following description. Thereafter, the controller 130 determines, in the first printing data stored in the RAM 133, a printing data unit that serves as a base, in accordance with which an one-pass image recording is to be performed on the recording sheet 15 by ejection of the ink droplets through the nozzles 36 in the next pass of the carriage 38 (at step S30). That is, the first printing data is an aggregation of a plurality of printing data units into which the first printing data is divided, and each of the printing data units represents an image (that may be referred also to as an image segment, as described above) that is to be recorded on the recording sheet 15 during a corresponding one pass of the carriage 38. FIG. 7A shows, by way of example, the first printing data as an aggregation of the printing data units for N lines. It is noted that, in FIGS. 7A-7D, numerals and alphabetical letters (i.e., I, N) represent respective line numbers.

Next, the controller 130 judges whether or not the trailing end of the recording sheet 15 has passed through a given position P (see FIG. 2) in the conveyance path 23 (at step 40). The given position P is a position which is located on an upstream side of the pair of conveying rollers 63 and which is distant from the pair of conveying rollers 63 by a given distance L0 (see FIG. 2). The given distance L0 is equal to a length L3 (as measured in the front-rear direction 8) of an intermediate region that is a part of an image recording area 14 (see a right side portion in FIG. 8) on the recording sheet 15. In the intermediate region (i.e., an intermediate portion of the recording sheet 15), the one-pass image recordings are performed in accordance with the first printing data and a second image-recording data that will be referred to as a second printing data in the following description, or are performed at a resolution which is higher than the first printing data and which is lower than the second printing data. In other words, in the intermediate region, some of the one-pass image recordings are performed in accordance with the first printing data while the other of the one-pass image recordings are performed in accordance with the second printing data. It is noted that, although the given position P is located on a downstream side of the detector 110 in the conveyance direction 16 in FIG. 2, the given position P may be located on an upstream side of the detector 110 in the conveyance direction 16.

Figure 8:
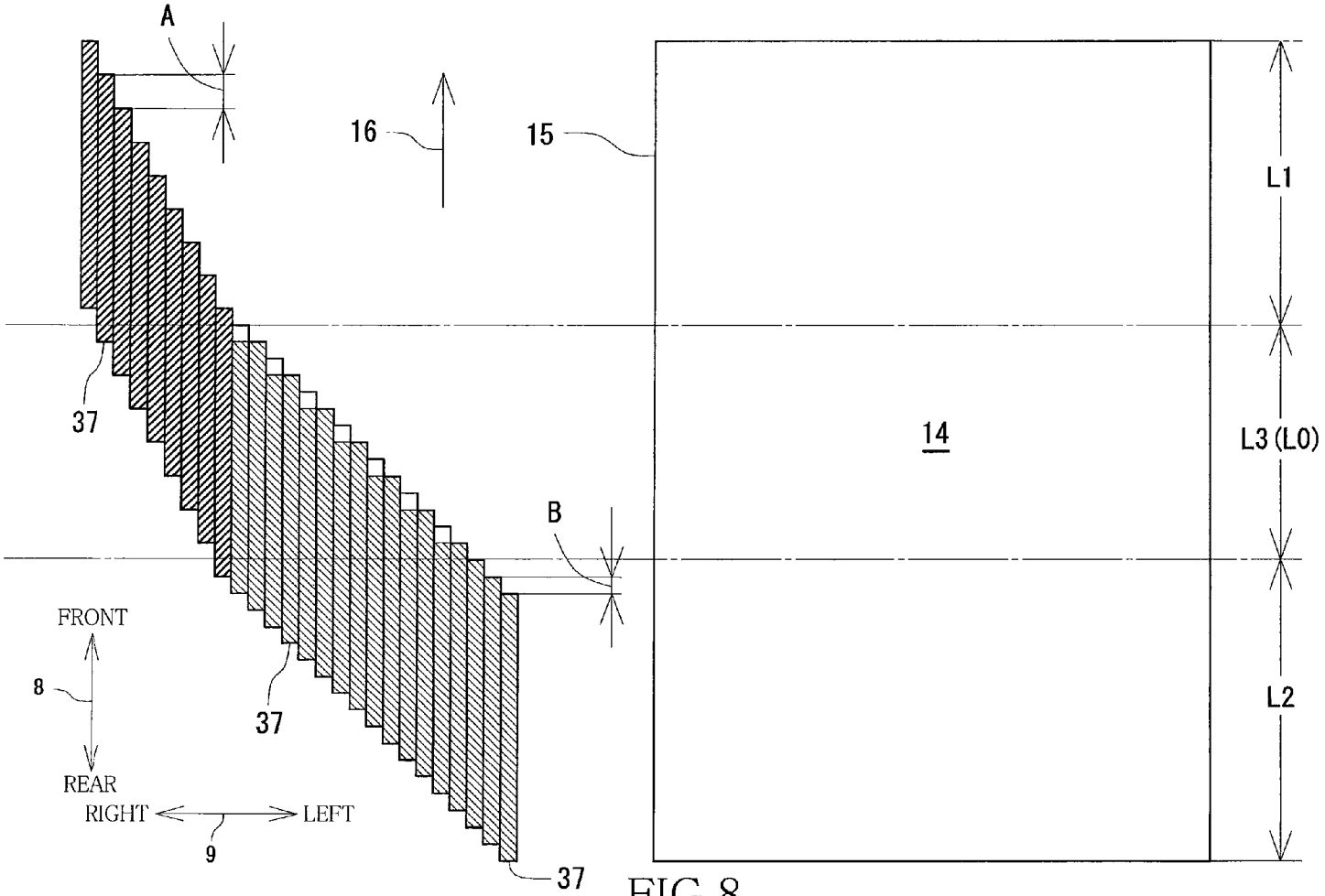
FIG. 8 is a view for explaining a process of carrying out an image recording operation on the sheet 15, in accordance with the printing data.

FIG. 8 shows a given length L1 (as measured in the front-rear direction 8) of a first region that is also a part of the image recording area 14 on the recording sheet 15. In the first region (i.e., a front portion of the recording sheet 15), each one-pass image recording is performed in accordance with the first printing data. FIG. 8 shows also a given length L2 (as measured in the front-rear direction 8) of a second region that is also a part of the image recording area 14 on the recording sheet 15. In the second region (i.e., a rear portion of the recording sheet 15), each one-pass image recording is performed in accordance with the second printing data. It is preferable that, when each one-pass image recording is being performed on the second region, the printing data has been switched completely from the first printing data to the second printing data.

FIG. 8 is a view for explaining a process of carrying out an image recording operation in accordance with the printing data. FIG. 8 shows, in its right side portion, the recording sheet 15 that is to be subjected to the image recording operation. Further, FIG. 8 shows, in its left side portion, a position of the recording head 37 relative to the recording sheet 15 in each of the successive passes of the carriage 38. The image recording operation is carried out by a series of one-pass image recordings each of which is performed by ejection of the ink droplets through nozzles 36 that are located in a hatched portion of the recording head 15 in a corresponding one of the successive passes of the carriage 38. It is noted that, although it is illustrated in FIG. 8 as if an absolute position of the recording head 37 in the conveyance direction 16 (i.e., front-rear direction 8) were changed after each pass of the carriage 38, the absolute position of the recording head 37 in the conveyance direction 16 is actually fixed, and the recording sheet 16 is conveyed by a first conveyance distance A or a second conveyance distance B (that will be described below) after each pass of the carriage 38. The first conveyance distance A and the second conveyance distance B are both smaller than a length of each of the rows of the nozzles 36 as measured in the conveyance direction 16 (i.e., front-rear direction 8).

In the present embodiment, the above-described judgment as to whether or not the trailing end of the recording sheet 15 has passed through the given position P, is made by the controller 130, based on detection of the trailing end or leading end of the recording sheet 15 in the conveyance direction 16 and also calculation of a distance of conveyance of the recording sheet 15, wherein the detection of the trailing end or leading end of the recording sheet 15 is made based on the signal supplied from the optical sensor 113, while the calculation of the conveyance distance of the recording sheet 15 is made based on the pulse signal supplied from the optical sensor 75. In an arrangement where the given position P is located on an upstream side of the detector 110 in the conveyance direction 16, the controller 130 makes the above-described judgment, for example, based on detection of the leading end of the recording sheet 15 (which is made based on the signal supplied from the optical sensor 113) and also calculation of the conveyance distance of the recording sheet 15 (which is made based on the pulse signal supplied from the optical sensor 75).

When the controller 130 judges that the trailing end of the recording sheet 15 (that is being subjected to the image recording operation) has not yet passed through the given position P in the conveyance path 23 ("No" at step S40), the controller 130 judges whether or not the next pass of the carriage 38 will be an odd-numberth pass as counted from start of the image recording operation (at step S50).

When the next pass corresponds to an odd-numberth pass as counted from start of the image recording operation ("YES" at step S50), the controller 130 performs an one-pass image recording on the recording sheet 15 in accordance with a corresponding one of the printing data units at an ink-ejection duty ratio of 100% (at step S60).

The above-described ink-ejection duty ratio is a ratio of an actual number of the ink droplets actually ejected in each image recoding (that is performed in each pass of the carriage 38), to a required number of the ink droplets which are required for recording an image (that may be referred also to as an image segment, as described above) represented by a corresponding one of the printing data units of the printing data. More specifically, the ink-ejection duty ratio is a ratio of an actual number of the ink droplets actually ejected through each one of the nozzles 36 in each one-pass image recording, to a required number of the ink droplets which are required to be ejected through each one of the nozzles 36 for recording an image (that may be referred also to as an image segment) represented by a corresponding one of the printing data units of the printing data. In other words, the ink-ejection duty ratio is a ratio of an actual number of times at which the ink droplet is actually ejected through each one of the nozzles 36 in each one-pass image recording, to a required number of times at which the ink droplet is required to be ejected through each one of the nozzles 36 for recording an image (that may be referred also to as an image segment) represented by a corresponding one of the printing data units of the printing data. For example, in case of the ink-ejection duty ratio of 100%, the ink droplet is actually ejected through each nozzle 36 at the required number of times that is required for recording an image (that may be referred also to as an image segment) represented by the corresponding printing data unit of the printing data. In case of the ink-ejection duty ratio of 0%, no ink droplet is ejected through each nozzle 36 in the one-pass image recording. In case of the ink-ejection duty ratio of 60%, the ink droplet is actually ejected through each nozzle 36 at a number of times that corresponds to 60% of the required number of times. Described more specifically, in case of the ink-ejection duty ratio of 50%, the ink droplet is actually ejected through one of the nozzles 36 for recording odd-numberth pixels in the one-pass image recording while the ink droplet is not ejected through this one of the nozzles 36 for recording even-numberth pixels in the one-pass image recording.

In each one-pass image recording that is performed in each pass of the carriage 38, the controller 130 outputs a PWM signal corresponding to a given ink-ejection duty ratio, for each piezoelectric element 44. Thus, in each one-pass image recording, the ink droplet is ejected through each nozzle 36 at a number of times that corresponds to the given ink-ejection duty ratio. At step S60, the controller 130 outputs a PWM signal corresponding to the ink-ejection duty ratio of 100%, for each piezoelectric element 44, so that the one-pass image recording is performed on the recording sheet 15, by causing the ink droplet to be ejected through each nozzle 36 at a required number of times that is required for recording an image (that may be referred also to as an image segment) represented by the corresponding printing data unit of the printing data.

When it is judged that the next pass of the carriage 38 will be an even-numberth pass as counted from start of the image recording operation ("NO" at step S50), the controller 130 does not execute the one-pass image recording in the next pass (at step S70).

In this step S70, since the one-pass image recording is not executed, the controller 130 requires neither to move the carriage 38 nor to stop conveyance of the recording sheet 15. Therefore, in the present embodiment, as long as the trailing end of the recording sheet 15 has not yet passed through the given position P ("NO" at step S40), the controller 130 executes the one-pass image recording by stopping conveyance of the recording sheet 15 only in the odd-numberth passes. In this case, an amount of each one of the intermittent conveyance motions of the recording sheet 15 corresponds to the first conveyance distance A (see the left side portion of FIG. 8).

As described above, when the trailing end of the recording sheet 15 does not yet pass through the given position P in the conveyance path 23, namely, when the trailing end of the recording sheet 15 does not yet pass through the pair of conveying rollers 63, the controller 130 performs each image recording on the recording sheet 15 in accordance with the first printing data that is stored in the RAM 133.

When the controller 130 judges that the trailing end of the recording sheet 15 subjected to the image recording operation has passed through the given position P in the conveyance path 23 ("YES" at step S40), the controller 130 executes the image data masking (at step S80) and performs each image recording on the recording sheet 15 in accordance with the corresponding printing data unit at an ink-ejection duty ratio corresponding to the image data masking (at step S90).

When the image recordings in accordance with all of the printing data units of the printing data have been completed ("NO" at step S10), the controller 130 causes the pair of discharging rollers 66 to convey the recording sheet 15 in the conveyance direction 16 until the recording sheet 15 is discharged to the sheet exit tray 21.

[Image Recording Based on Second Printing Data]

When the trailing end of the recording sheet 15 has passed through the given position P in the conveyance path 23 ("YES" at step S40), the controller 130 starts switching of the printing data (in accordance with which each image recording is to be performed on the recording sheet 15) from the first printing data to the second printing data. The second printing data has the same content as the first printing data, and makes it possible to record an image on the recording sheet 15 at a higher image resolution than the first printing data. In other words, the second printing data is a data which is prepared based on the first printing data and which has a higher image resolution than the first printing data. At a point of time at which the trailing end of the recording sheet 15 has passed through the pair of conveying rollers 63, the printing data (in accordance with which the image recordings are to be performed on the recording sheet 15) has been completely switched, by the controller 130, from the first printing data to the second printing data.

For example, the controller 130 causes the recording head 37 to perform each image recording in accordance with the first printing data in a first stage in which the trailing end of the recording sheet 15 has not yet passed through the given position P in the conveyance path 23. The controller 130 causes the recording head 37 to perform each image recording in accordance with the first printing data and second printing data in an intermediate stage in which the trailing end of the recording sheet 15 has passed through the given position P and has not yet passed through the pair of conveying rollers 63. Further, the controller 130 causes the recording head 37 to perform each image recording in accordance with the second printing data in a second stage in which the trailing end of the recording sheet 15 has passed through the pair of conveying rollers 63.

Figure 7B:
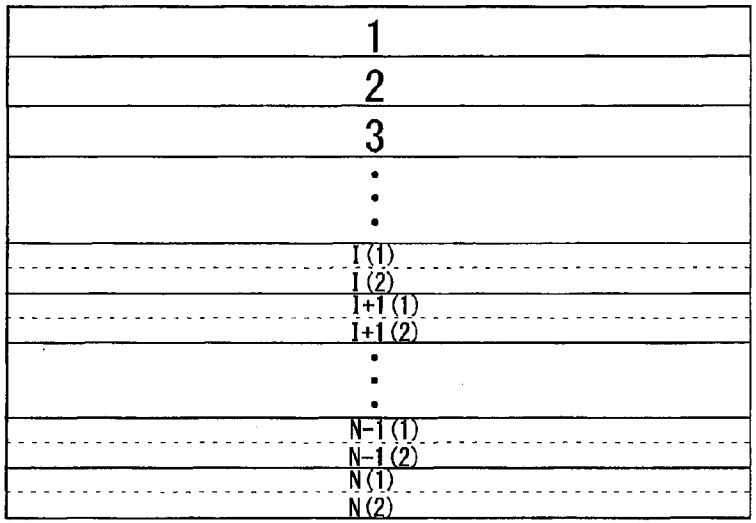
FIG. 7B is a view schematically showing image recordings that are performed on the sheet 15, in accordance with the first printing data and a second printing data.
Figure 7C:
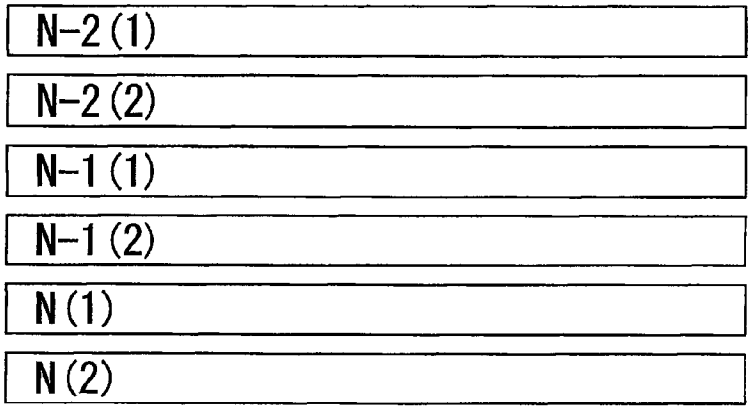
FIG. 7C is a view schematically showing image recordings that are performed on the sheet 15, in accordance with the second printing data.

The second printing data is a printing data in which a given number of each of the above-described printing data units are arranged, more specifically, in which the given number of each of ones of the printing data units are arranged, wherein the ones of the printing data units are data units in accordance with which the image recordings are to be performed after the trailing end of the recording sheet 15 has passed through the pair of conveying rollers 63. In the present embodiment, the above-described given number is set to two. Specifically described, as shown in FIGS. 7B and 7C, in the second printing data, two of each of the printing data units from the printing data unit corresponding to "Ith" line to the printing data unit corresponding to "Nth" line (i.e., final line), are arranged. In FIG. 7B, for example, "I(1)" represents a first one of two printing data units that correspond to "Ith" line, and "I(2)" represents a second one of the two printing data units that correspond to "Ith" line. It is noted that the second image-recording data may be defined as an aggregation of a plurality of printing data unit sets (i.e., recording data unit sets) into which the second image-recording data is divided, such that each of the printing data unit sets consists of a given number of printing data units each of which is constituted by a corresponding one of the above-described plurality of printing data units. In FIG. 7B, for example, the printing data unit set corresponding to "Nth" line consists of two printing data units N(1), N(2), and each of the two printing data units N(1), N(2) is constituted by the printing data unit N as a corresponding one of the plurality of printing data units into which the first printing data is divided.

In the present embodiment, each image recording comes to be performed in accordance with the second printing data, after a manner for controlling each image recording by the controller 130 has been changed, namely, after the implementations of steps S50, S60 and S70 (see FIG. 3) have been switched to the implementations of step S80 and S90 (see FIG. 3), for controlling each image recording by the controller 130. That is, by the implementations of steps S50, S60 and S70, each image recording is performed on the recording sheet 15 in accordance with the first printing data. By the implementations of step S80 and S90, each image recording is performed on the recording sheet 15 in accordance with the second printing data.

Further, after the trailing end of the recording sheet 15 has passed through the given position P in the conveyance path 23 ("YES" at step S40), the controller 130 changes the amount of each one of the intermittent conveyance motions, from the first conveyance distance A (see FIG. 8) to the second conveyance distance B (see FIG. 8). The second conveyance distance B is an amount of conveyance of the recording sheet 15 which enables images (that may be referred also to as image segments) based on the respective printing data units to be recorded evenly on the recording sheet 15 in the conveyance direction 16, i.e., the front-rear direction 8 (as an example of a sub-scanning direction). In the present embodiment, after the trailing end of the recording sheet 15 has passed through the given position P, the recording sheet 15 is stopped at every one of the passes of the carriage 38, and the one-pass image recording is performed with the amount of each one of the intermittent conveyance motions of the recording sheet 15 being set to the second conveyance distance B, which is a half (½) of the first conveyance distance A. That is, the second conveyance distance B is equal to a quotient of the first conveyance distance A divided by the above-described given number. As shown in FIG. 7B, the images (or image segments) based on the respective printing data units (e.g., I(1), I(2)) are recorded on the recording sheet 15 evenly in the front-rear direction 8, by the intermittent conveyance motions each of which causes the recording sheet 15 to be conveyed by the second conveyance distance B. It is noted that the second conveyance distance B does not necessarily have to be a constant amount but may be a variable amount so that the images based on the respective printing data units can be recorded unevenly on the recording sheet 15 in the conveyance direction 16. That is, the arrangement for enabling the images based on the respective printing data units to be recorded evenly in the conveyance direction 16 is not essential.

Upon satisfaction of a condition that the trailing end of the recording sheet 15 has reached the given position P, the controller 130 gradually changes from the image recording in accordance with the first printing data which is performed with the first conveyance distance A, to the image recording in accordance with the second printing data which is performed with the second conveyance distance B. In the present embodiment, this gradual change is realized by implementations of steps S110 and S120 in flow chart of FIG. 4.

[Image Data Masking]

Referring next to flow chart of FIG. 4, the image data masking performed at step S80 in FIG. 3 will be described in detail. The controller 130 implements steps S110 through S150, for each of raster images recorded by ink droplet ejection through the respective nozzles 36 in each one-pass image recording. In the following description, the rater image is interpreted to mean a linear-shaped image which is to be recorded by ink droplet ejection through each nozzle 36 in each one-pass image recording and which extends in the right-left direction 9. Hereinafter, there will be described procedures carried out in steps S110 through S150 that are implemented for the raster image recorded by ink droplet ejection through a nozzle 36 as one of all the nozzles 36. It is noted that the linear-shaped image may be referred also to as a linear-shaped image element.

The controller 130 judges whether or not the raster image in question is a rater image that has been already recorded on the recording sheet 37 (at step S110). When the rater image in question is an already recorded raster image ("YES" at step S110), the image recording in accordance with the printing data unit that represents the already recorded raster image, is not performed on the recording sheet 15 (at step S120). Described in detail, as shown in FIG. 8, after the amount of each one of the intermittent conveyance motions has been switched from the first conveyance distance A to the second conveyance distance B, in each odd-numberth pass as counted from start of the image recording operation, the controller 130 does not cause the rater image in question to be recorded on the recording sheet 15, in a case when the raster image in question is to be recorded by ink droplet ejection through one of a given number of the nozzles 36, which are located in a downstream end portion of the recording head 37 in the conveyance direction 16, namely, which are located in a non-hatched portion of the recording head 37 as shown in FIG. 8. In such a case, the raster image in question has been already recorded (on the recording sheet 15) in accordance with the first printing data, although not yet having been recorded (on the recording sheet 15) in accordance with the second printing data. Thus, in the present embodiment, the above-described gradual change is realized by the implementations of steps S110 and S120 in flow chart of FIG. 4.

When the rater image in question is not an already recorded raster image ("NO" at step S110), the controller 130 judges whether not the next pass of the carriage 38 will be an even-numberth pass as counted from start of the image recording operation (at step S130).

When the next pass corresponds to an even-numberth pass as counted from start of the image recording operation ("YES" at step S130), the controller 130 masks the printing data unit with a mask M1 described below (at step S140), and then performs the image recording in accordance with the printing data unit that is masked with the mask M1 (at step S90 of FIG. 3). On the other hand, when the next pass corresponds to an odd-numberth pass as counted from start of the image recording operation ("NO" at step S130), the controller 130 masks the printing data unit with a mask M2 described below (at step S150), and then performs the image recording in accordance with the printing data unit that is masked with the mask M2 (at step S90 of FIG. 3).

Figure 7D:
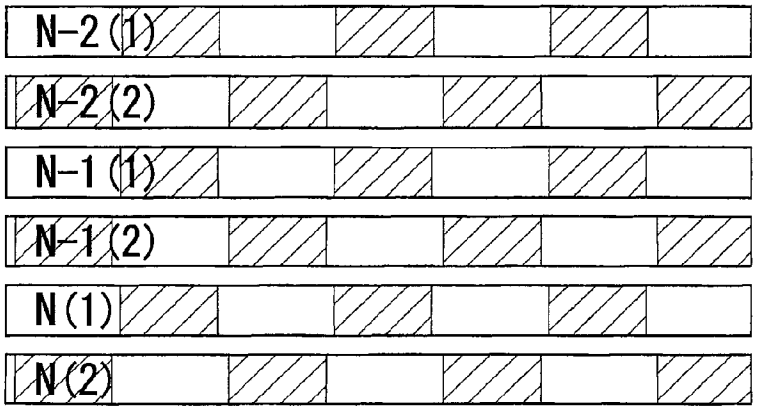
FIG. 7D is a view schematically showing image recordings that are performed on the sheet 15, in accordance with the second printing data that is partially masked.

The image data masking with the mask M1 is a treatment for masking a part or parts of the printing data unit, for performing the image recording on the recording sheet 15 with pixel skipping. Specifically described, for causing ink droplet ejection in accordance with the printing data unit that is masked with the mask M1, the controller 130 causes the ink droplet ejection, namely, performs the image recording on the recording sheet 15, at the ink-ejection duty ratio of at least 50% (53% in the present embodiment). In this case, an amount of the ink droplet ejection through the nozzles arranged in the nozzle row corresponds to 53% of that in case of the ink-ejection duty ratio of 100%. In each of N−2(1), N−1(1) and N(1) in FIG. 7D, there are schematically illustrated raster images that are recorded by the ink droplet ejection in accordance with the corresponding printing data unit masked with the mask M1. In FIG. 7D, hatched portions represents masked parts.

Like the image data masking with the mask M1, the image data masking with the mask M2 is a treatment for masking a part or parts of the printing data unit, for performing the image recording on the recording sheet 15 with pixel skipping. Specifically described, for causing ink droplet ejection in accordance with the printing data unit that is masked with the mask M2, the controller 130 causes the ink droplet ejection, namely, performs the image recording on the recording sheet 15, at the ink-ejection duty ratio of at least 50% (53% in the present embodiment). In each of N−2(2), N−1(2) and N(2) in FIG. 7D, there are schematically illustrated raster images that are recorded by the ink droplet ejection in accordance with the corresponding printing data unit masked with the mask M2. In FIG. 7D, hatched portions represents masked parts.

Thus, the controller 130 performs each image recording in accordance with the corresponding printing data unit of the second printing data at the predetermined ink-ejection duty ratio, by controlling the piezoelectric elements 44 of the recording head 37.

Further, as shown in FIG. 7D, the image recording in accordance with the printing data unit masked with the mask M1 and the image recording in accordance with the printing data unit masked with the mask M2 are performed on respective recording areas that are complementary with each other. That is, the above-described given number of each of the arranged printing data units of the second printing data are masked at respective masked parts (i.e., hatched portions in FIG. 7D) thereof which are different from each other, for example, with respect to a position of a section of the image represented by the masked part in the main scanning direction.

Further, as described above, the ink-ejection duty ratio, which is established by each of the mask M1 and the mask M2, is higher than 50%. Therefore, as shown in FIG. 7D, an unmasked part (i.e., non-hatched portion in FIG. 7D) of the printing data unit which is not masked with the mask M1 and an unmasked part (i.e., non-hatched portion in FIG. 7D) of the printing data unit which is not masked with the mask M2 partially overlap with each other. That is, a sum of the ink-ejection duty ratios at which the image recordings in accordance with the respective given number of each of the printing data units are performed, is set to a value larger than 100%. In the present embodiment, this sum corresponds to a sum of the ink-ejection duty ratio established by the mask M1 and the ink-ejection duty ratio established by the mask M2, and this sum is set to 106% (=53%+53%). A It is noted that this sum of the ink-ejection duty ratios may be 100%.

As described above, in the present embodiment, the image recordings in accordance with the second printing data are performed, by performing each two consecutive image recordings in accordance with the same printing data unit (that is constituted by a corresponding one of the data units into which the first printing data is divided into), in other words, by performing each image recording two consecutive times in accordance with the same printing data unit. That is, in the present embodiment, since the second printing data is constituted by the printing data units that constitutes also the first printing data, only the first printing data is stored in the RAM 133, so that each image recording in accordance with the second printing data is performed by changing the image recording control that is executed by the controller 130. However, the controller 130 may prepare, based on the first printing data shown in FIG. 7A, the second printing data shown in FIG. 7B, prior to the image recording operation, and cause the second printing data as well as the first printing data to be stored in the RAM 133. In this modified arrangement, the controller 130 may switch the printing data (in accordance with which each image recording to be performed), from the first printing data to the second printing data, upon satisfaction of an condition that the trailing end of the recording sheet 15 has reached the above-described given position P.

Figure 3:
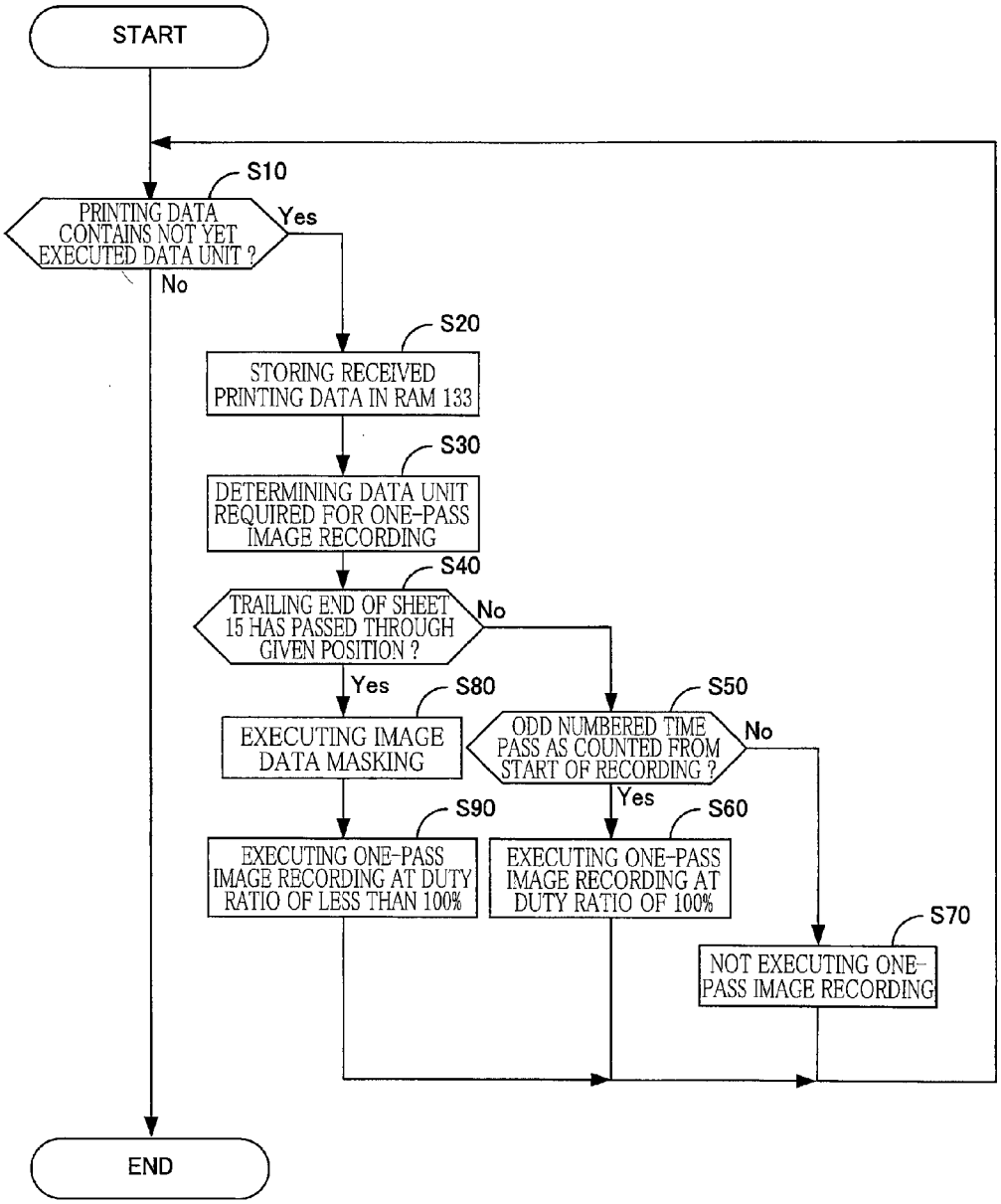
FIG. 3 is a flow chart showing a routine for controlling an image recording operation performed in the compound machine 1.
Figure 4:
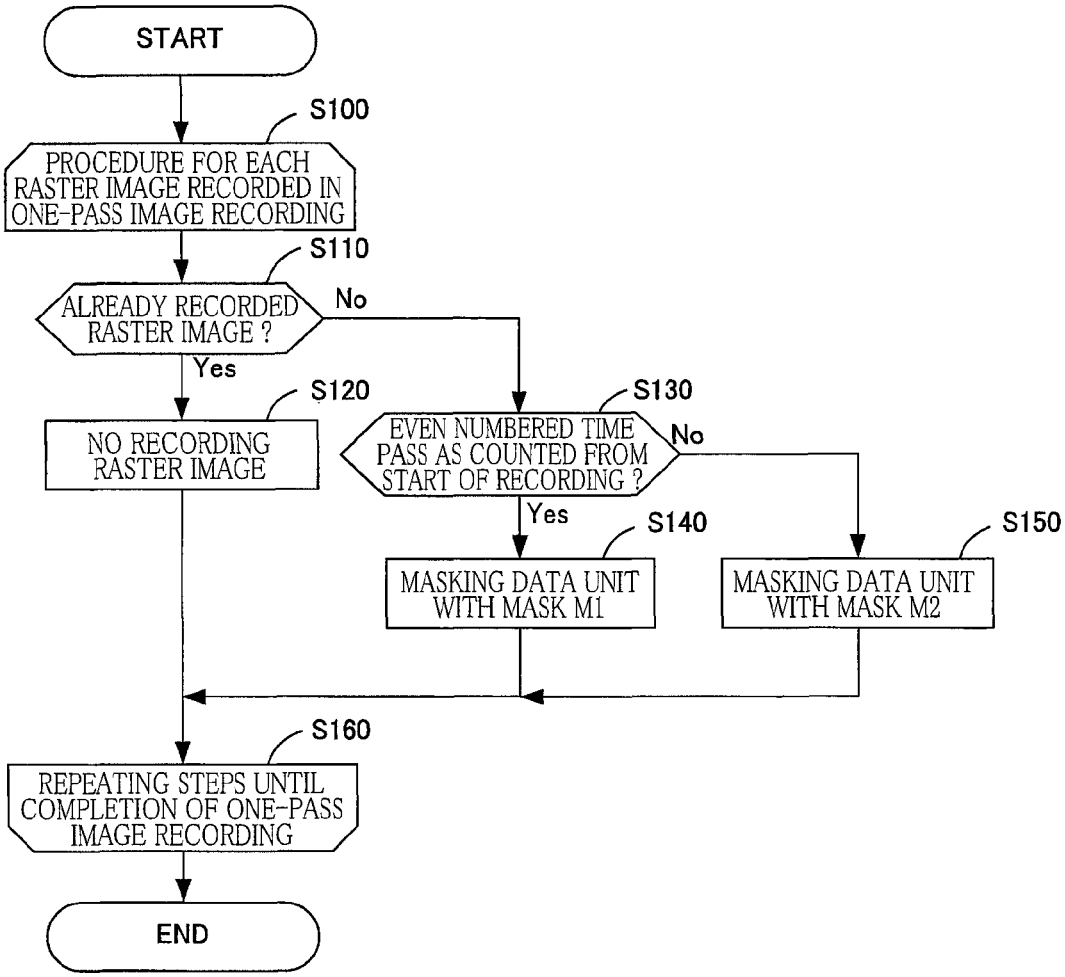
FIG. 4 is a flow chart showing a routine for image data masking performed in the compound machine 1.

As described above, the controller 130 carries out the routines shown in the flow charts of FIGS. 3 and 4, for thereby performing each image recording in accordance with the first printing data in a stage in which the trailing end of the recording sheet 15 has not yet passed through the pair of conveying rollers 63, and performing each image recording in accordance with the second printing data in place of the first printing data in a stage in which the trailing end of the recording sheet 15 has already passed through the pair of conveying rollers 63.

When the trailing end of the recording sheet 15 has passed through the pair of conveying rollers 63, a position of a portion of the recording sheet 15 which is in vicinity with the trailing end becomes unstable. In the present embodiment, the controller 130 is configured, when the recording sheet 15 is in such an unstable state, to cause each image recording in accordance with the second printing data having a higher image resolution, to be performed on the recording sheet 15.

Therefore, even if there is a risk that the image recording performed on the recording sheet 15 in such an unstable state would lead to a reduction of a quality of the recorded image, the quality of the recorded image is improved by increase of a resolution of the recorded image. That is, in the present embodiment, the reduction of the image quality can be restrained by the improvement of the image quality.

Further, in the present embodiment, in a stage in which the position of the portion of the recording sheet 15 which is in vicinity with the trailing end is unstable, the controller 130 is configured to cause each image recording in accordance with the second printing data to be performed with a reduced amount of each intermittent conveyance motion of the intermittent conveyance. Owing to this arrangement, a number of lines (as counted in the conveyance direction 16) in the recording sheet 15 is increased in its portion in which the image recordings in accordance with the second printing data are performed, so that a resolution of an image recorded on the recording sheet 15 is increased in the portion in which the image recordings in accordance with the second printing data are performed.

Further, in the present embodiment, the controller 130 causes an image (that may be referred also to as an image segment) represented by each printing data unit, to be recorded on the recording sheet 15 at a predetermined ink-ejection duty ratio. Where the ink-ejection duty ratio is 100%, the ink droplets are successively ejected through each nozzle 36 of the recording head 37 onto areas that require ejection of the ink droplets in accordance with the printing data, in the ink droplet ejection that is performed each time the recording sheet 15 is being stopped in the intermittent conveyance. That is, the ejection of the ink droplets through each nozzle 36 is not masked. On the other hand, where the ink-ejection duty ratio is lower than 100%, the ejection of the ink droplets through each nozzle 36 is masked at a ratio that is dependent on the ink-ejection duty ratio.

The amount of the ink droplets ejected through each nozzle 36 of the recording head 37 is larger when the ink droplets are successively ejected through the nozzle 36 in the ink droplet ejection, than when the ink droplets are non-successively ejected through the nozzle 36 in the ink droplet ejection. When the ink-ejection duty ratio is 100% in the ink droplet ejection performed each time the recording sheet 15 is being stopped in the intermittent conveyance, the ink droplets are successively ejected through each nozzle 36 of the recording head 37. However, when the ink-ejection duty ratio is lower than 100% in the ink droplet ejection performed each time the recording sheet 15 is being stopped in the intermittent conveyance, the ink droplets are intermittently ejected through the masked nozzles 36 rather than being successively ejected. Therefore, as compared with in the case of the ink-ejection duty ratio of 100%, in the case of the ink-ejection duty ratio of lower than 100%, the amount of the ink droplets ejected through each nozzle 36 is smaller, even if a sum of the ink-ejection duty ratios at which the plurality of image recordings are performed, is larger than 100%.

Each image recording in accordance with the corresponding printing data unit of the second printing data is performed by the controller 130 on the recording sheet 15, at the ink-ejection duty ratio that is, normally, lower than 100%. On the other hand, each image recording in accordance with the corresponding printing data unit of the first printing data is performed by the controller 130 on the recording sheet 15, without masking the ink droplet ejection through the nozzles 36, i.e., at the ink-ejection duty ratio of 100%. Therefore, the amount of the ejected ink droplets is smaller in each image recording in accordance with the second printing data than in each image recording in accordance with the first printing data.

In view of the above, in the present embodiment, the sum of the ink-ejection duty ratios at which the image recordings in accordance with the respective given number of each of the printing data units of the second printing data are performed by the controller 130 on the recording sheet 15, is made larger than 100%. Owing to this arrangement, it is possible to prevent reduction of the amount of the ink droplets actually ejected through the nozzles 36.

Further, in the present embodiment, the above-described given number of each of the printing data units are masked at respective parts thereof that are different from each other, so that it is possible to prevent darkening of a portion of the recording sheet 15 on which the image recordings in accordance with the second printing data are performed.

If the amount of each one of the intermittent conveyance motions of the intermittent conveyance is abruptly switched from the first conveyance distance A to the second conveyance distance B and the printing data (in accordance with which each image recording is performed) is abruptly switched from the first printing data to the second printing data, there is a risk that an image turbulence would be caused at a boundary between a portion of the recording sheet 15 on which the image recordings in accordance with the first printing data are performed and a portion of the recording sheet 15 on which the image recordings in accordance with the second printing data are performed. In the present embodiment, however, the amount of each one of the intermittent conveyance motions of the intermittent conveyance is gradually changed, and the printing data (in accordance with which each image recording is performed) is also gradually changed, so that it is possible to prevent the image turbulence from being caused.

First Modification

As described above, the controller 130 controls, based on the printing data, the electric current supplied to each piezoelectric element 44, for thereby adjusting the size of the ink droplets ejected through the corresponding nozzle 36. In most cases, the controller 130 controls the electric current supplied to each piezoelectric element 44 such that the ink droplets having a size dependent on a type of the recording sheet, are ejected through the corresponding nozzle 36. In the above-described embodiment, the controller 130 controls the supplied electric current such that the ink droplets having a first size are ejected through the nozzles 36, irrespective of whether the image recording is performed in accordance with the first printing data or in accordance with the second printing data, namely, such that the ink droplets having the first size are ejected through the nozzles 36 in both of steps S60 and S90 of FIG. 3.

Figure 5:
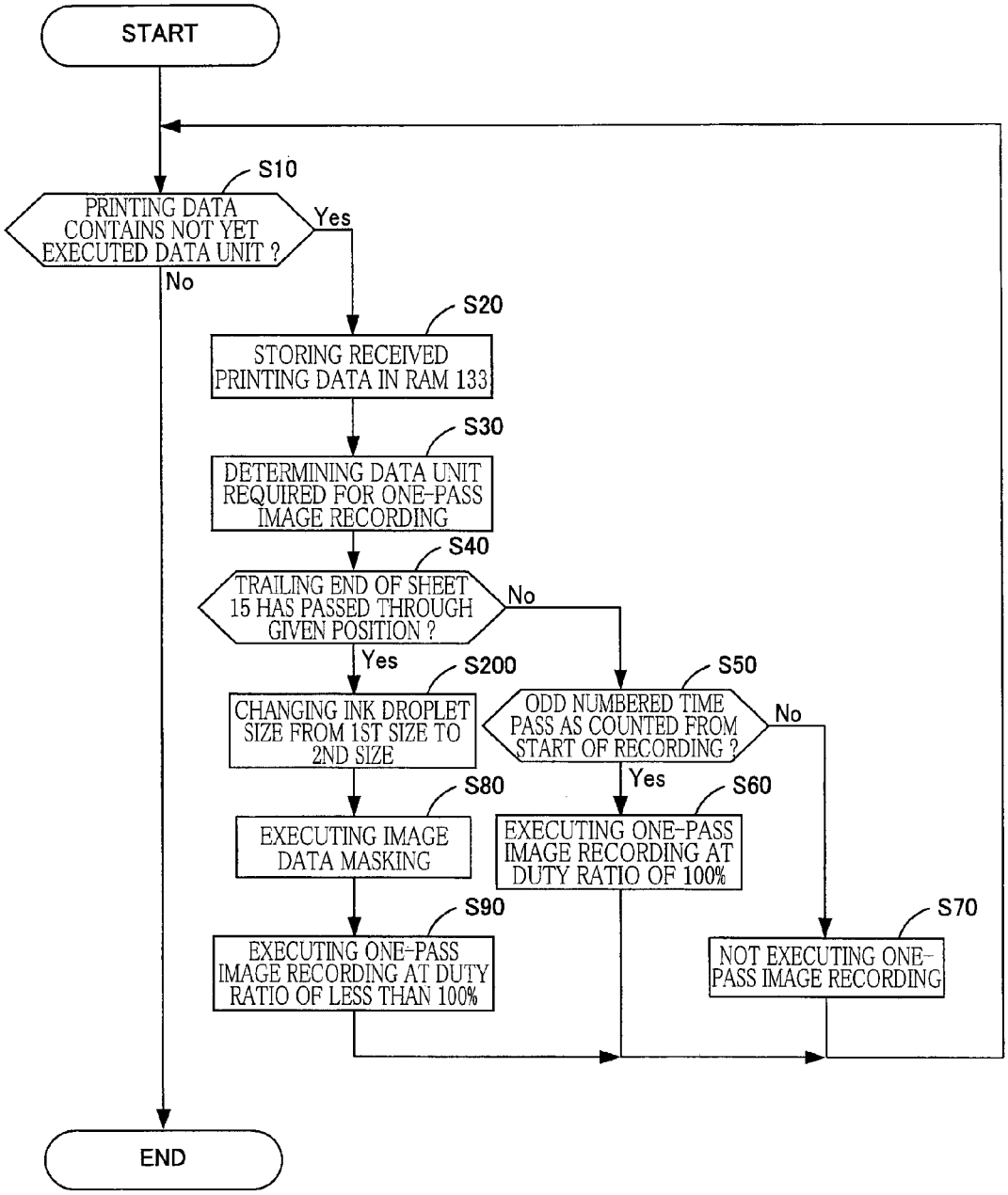
FIG. 5 is a flow chart showing a routine for controlling an image recording operation performed in a first modification of the embodiment.

In this first modification, as shown in FIG. 5, when the controller 130 judges that the trailing end of the recording sheet 15 has passed through the given position P in the conveyance path 23 ("YES" at step S40), the controller 130 changes a level of the electric current supplied to the piezoelectric elements 44. Specifically described, the electric current (supplied to the piezoelectric element 44), which has been adjusted to cause the ink droplets of the first size to be ejected through the nozzles 36, is adjusted to cause the ink droplets of a second size to be ejected through the nozzles 36 (at step S200). Each of the nozzles 36 is constructed to be capable of ejecting therethrough the first-sized ink droplets and the second-sized ink droplets that are larger in size than the first-sized ink droplets. It is noted that the routine shown in FIG. 5 is the same as the routine shown in FIG. 3, except for step S200 which is not included in the routine of FIG. 3.

Thus, the controller 130 is configured to cause the recording head 37 to eject the first-sized ink droplets through the nozzles 36 when each image recording in accordance with the first printing data is performed on the recording sheet 15, and to cause the recording head 37 to eject the second-sized ink droplets through the nozzles 36 when each image recording in accordance with the second printing data is performed on the recording sheet 15.

As described above in the description of the above embodiment, the amount of the ink droplets ejected in each image recording in accordance with the second printing data is smaller than the amount of the ink droplets ejected in each image recording in accordance with the first printing data. In view of this, in the first modification, the size of the ink droplets ejected through the nozzles 36 in each image recording in accordance with the second printing data performed on the recording sheet 15, is made larger than the size of the ink droplets ejected through the nozzles 36 in each image recording in accordance with the first printing data performed on the recording sheet 15. Owing to this arrangement, it is possible to prevent reduction of the amount of the ink droplets actually ejected through the nozzles 36.

Second Modification

Figure 6:
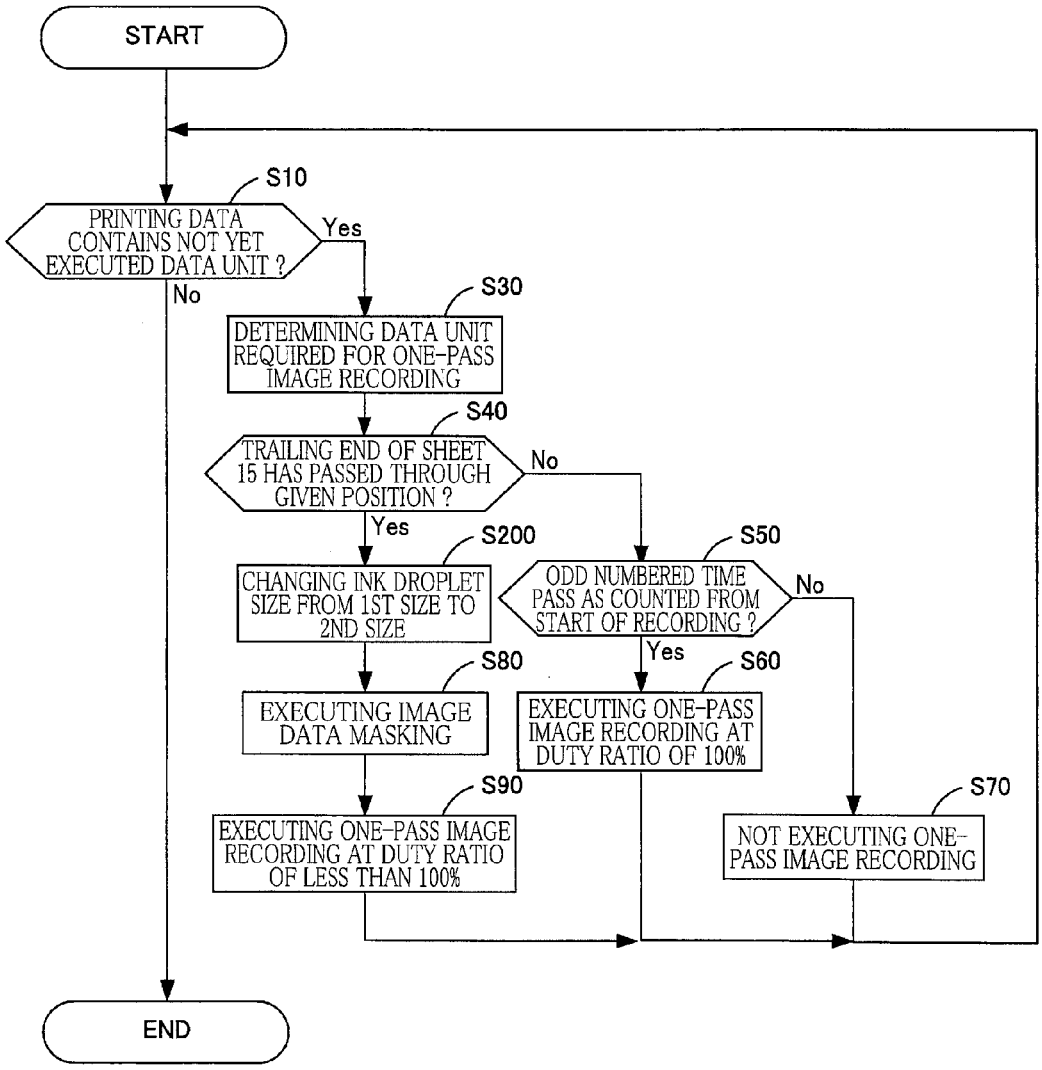
FIG. 6 is a flow chart showing a routine for controlling an image recording operation performed in a second modification of the embodiment.

In the above-described embodiment, the controller 130 causes the RAM 133 to store therein the printing data that has been inputted at step S10 (at step S20), and then executes the image data masking for the printing data stored in the RAM 133. However, these procedures may be carried out by hardware. For example, the controller 130 may be provided with another ASIC that is configured to carry out these procedures, in addition to the ASIC 135 or as a part of the ASIC 135, and the printing data may be inputted into the another ASIC at step S10, so that various judgments and the image data masking are executed in the another ASIC. Thus, with the procedures being executed by the hardware rather than software, it is possible to eliminate step S20 of FIG. 3, as shown in FIG. 6.

What is claimed is:

1. An inkjet recording device comprising:

a first pair of rollers and a second pair of rollers that is disposed on a downstream side of said first pair of rollers in a conveyance direction, said first and second pairs of rollers being configured to convey a sheet in the conveyance direction that is along a conveyance path while nipping the sheet, such that a leading end of the conveyed sheet is positioned on a front side of a trailing end of the conveyed sheet in the conveyance direction;

a recording head disposed between said first pair of rollers and said second pair of rollers in the conveyance direction, said recording head being configured to eject ink droplets toward the conveyance path through nozzles that are arranged in the conveyance direction; and a controller configured to cause said first and second pairs of rollers to perform an intermittent conveyance for alternately conveying and stopping the sheet, and to cause said recording head to perform an image recording on the sheet by ejecting the ink droplets onto the sheet when the sheet is stopped in the intermittent conveyance, wherein said controller is configured to cause said recording head to perform the image recording in accordance with a first image-recording data, before the trailing end of the sheet passes through said first pair of rollers, wherein said controller is configured to cause said recording head to perform the image recording in accordance with a second image-recording data which is based on said first image-recording data and which has a higher image resolution than said first image-recording data, after the trailing end of the sheet passes through said first pair of rollers, wherein said nozzles are arranged in a row which extends in the conveyance direction and which has a given length as measured in the conveyance direction, and wherein said controller is configured to set a conveyance distance as an amount of each one of intermittent conveyance motions of the intermittent conveyance, such that the conveyance distance is smaller than the given length of said row of said nozzles.

2. The inkjet recording device according to claim 1, wherein said first image-recording data is an aggregation of a plurality of recording data units into which said first image-recording data is divided, wherein said second image-recording data is a recording data in which a given number of each of said recording data units are arranged, wherein said controller is configured to cause said recording head to perform the image recording in accordance with each of said recording data units when the sheet is stopped in the intermittent conveyance, wherein said controller is configured to set the conveyance distance to a first conveyance distance before the trailing end of the sheet passes through said first pair of rollers, and wherein said controller is configured to set a second conveyance distance after the trailing end of the sheet passes through said first pair of rollers, such that images based on said respective recording data units are recorded on the sheet and the recorded images based on said respective recording data units are arranged in a sub-scanning direction that is parallel with the conveyance direction.

3. The inkjet recording device according to claim 2, wherein said controller is configured to control said recording head, such that the image recording in accordance with each of said recording data units of said second image-recording data is performed at an ink-ejection duty ratio, and such that a sum of the ink-ejection duty ratios at which the image recordings in accordance with the respective given number of each of said recording data units of said second image-recording data are performed, is larger than 100%.

4. The inkjet recording device according to claim 3, wherein said controller is configured to control said recording head, such that the image recording in accordance with each of said recording data units of said second image-recording data is performed at the ink-ejection duty ratio that is a ratio of an actual number of the ink droplets actually ejected in the image recording to a required number of the ink droplets which are required for recording an image represented by said each of said recording data units.

5. The inkjet recording device according to claim 2, wherein the given number of each of said recording data units are masked at respective parts thereof that are different from each other.

6. The inkjet recording device according to claim 2, wherein said recording head is configured to eject, as the ink droplets, first-sized ink droplets and second-sized ink droplets that are larger in size than the first-sized ink droplets, through said nozzles, and wherein said controller is configured to cause said recording head to eject the first-sized ink droplets through said nozzles when the image recording in accordance with said first image-recording data is performed on the sheet, and to cause said recording head to eject the second-sized ink droplets through said nozzles when the image recording in accordance with said second image-recording data is performed on the sheet.

7. The inkjet recording device according to claim 2, wherein said controller is configured, upon satisfaction of a condition that the trailing end of the sheet has reached a position that is located on an upstream side of said first pair of rollers in the conveyance direction, to gradually change from the image recording in accordance with said first image-recording data performed with the first conveyance distance to the image recording in accordance with said second image-recording data performed with the second conveyance distance.

8. The inkjet recording device according to claim 1, wherein said first image-recording data is an aggregation of a plurality of recording data units into which said first image-recording data is divided, wherein said second image-recording data is a recording data in which a given number of each of said recording data units are arranged, wherein said controller is configured to cause said recording head to perform the image recording in accordance with each of said recording data units when the sheet is stopped in the intermittent conveyance, wherein said controller is configured to set the conveyance distance to a first conveyance distance before the trailing end of the sheet passes through said first pair of rollers, and wherein said controller is configured to set the conveyance distance to a second conveyance distance after the trailing end of the sheet passes through said first pair of rollers, such that images based on said respective recording data units are recorded on the sheet evenly in a sub-scanning direction that is parallel with the conveyance direction.

9. The inkjet recording device according to claim 1, wherein said controller is configured, upon satisfaction of a condition that the trailing end of the sheet has reached a position that is located on an upstream side of said first pair of rollers in the conveyance direction, to gradually change from the image recording in accordance with said first image-recording data to the image recording in accordance with said second image-recording data.

10. The inkjet recording device according to claim 1, wherein said first image-recording data is an aggregation of a plurality of recording data units into which said first image-recording data is divided, wherein said second image-recording data is a recording data in which a given number of each of said recording data units are arranged, and wherein said controller is configured to control said first and second pairs of rollers, such that the amount of each one of intermittent conveyance motions of the intermittent conveyance before the trailing end of the sheet passes through said first pair of rollers, is set to a first conveyance distance, and such that the amount of each one of the intermittent conveyance motions of the intermittent conveyance after the trailing end of the sheet passes through said first pair of rollers, is set to a second conveyance distance that substantially corresponds to a quotient of the first conveyance distance divided by the given number.

11. The inkjet recording device according to claim 1, wherein said first image-recording data is an aggregation of a plurality of recording data units into which said first image-recording data is divided, wherein said second image-recording data is an aggregation of a plurality of recording data unit sets into which said second image-recording data is divided, such that each of said recording data unit sets consists of a given number of recording data units each of which is constituted by a corresponding one of said plurality of recording data units, and wherein said controller is configured to cause said recording head to perform the image recording in accordance with each of said recording data units when the sheet is stopped in the intermittent conveyance.

12. The inkjet recording device according to claim 11, wherein said controller is configured to control said first and second pairs of rollers, such that the amount of each one of intermittent conveyance motions of the intermittent conveyance before the trailing end of the sheet passes through said first pair of rollers, is set to a first conveyance distance, and such that the amount of each one of the intermittent conveyance motions of the intermittent conveyance after the trailing end of the sheet passes through said first pair of rollers, is set to a second conveyance distance that substantially corresponds to a quotient of the first conveyance distance divided by the given number.

13. The inkjet recording device according to claim 1, wherein said controller is configured to cause the image recording in accordance with the first image-recording data to be performed on a front portion of the sheet that is located on a side of the leading end of the sheet, wherein said controller is configured to cause the image recording in accordance with the second image-recording data to be performed on a rear portion of the sheet that is located on a side of the trailing end of the sheet, and wherein said controller is configured to cause the image recording in accordance with the first image-recording data and the second image-recording data to be performed on an intermediate portion of the sheet that is located between the front and rear portions of the sheet.

* * * * *